United States Patent [19]

Slaghuis et al.

[11] Patent Number: 4,625,929

[45] Date of Patent: Dec. 2, 1986

[54] METHOD AND DEVICE FOR AVOIDING IRREGULAR OR RIBBON WINDINGS DURING THE WINDING OF CHEESES OR CROSS-WOUND BOBBINS

[75] Inventors: Hermann Slaghuis; Heinz G. Bender, both of Monchen-Gladbach, Fed. Rep. of Germany

[73] Assignee: W. Schlafhorst & Co., Monchen-Gladbach, Fed. Rep. of Germany

[21] Appl. No.: 628,728

[22] Filed: Jul. 9, 1984

[30] Foreign Application Priority Data

Jul. 9, 1983 [DE] Fed. Rep. of Germany ..... 3324889

[51] Int. Cl.[4] ..... B65H 54/38

[52] U.S. Cl. ..... 242/18.1; 242/18 DD

[58] Field of Search ..... 242/18.1, 18 DD, 35.5 R, 242/35.6 R

[56] References Cited

U.S. PATENT DOCUMENTS

| | | | |
|---|---|---|---|
| 2,066,494 | 1/1937 | Swanson | 242/18.1 |
| 2,862,672 | 12/1958 | Pool et al. | 242/18.1 |
| 3,847,364 | 11/1974 | Rohner et al. | 242/18.1 |
| 4,059,239 | 11/1977 | Hori et al. | 242/18.1 |

FOREIGN PATENT DOCUMENTS

| | | | |
|---|---|---|---|
| 679837 | 8/1939 | Fed. Rep. of Germany | 242/18.1 |
| 1051657 | 9/1953 | France | 242/18.1 |
| 586069 | 3/1947 | United Kingdom | 242/18.1 |
| 897882 | 5/1962 | United Kingdom | 242/18.1 |

*Primary Examiner*—Stanley N. Gilreath

*Attorney, Agent, or Firm*—Herbert L. Lerner; Laurence A. Greenberg

[57] ABSTRACT

A method for avoiding irregular or ribbon windings while winding cross-wound bobbins with scrambled windings, including a movable bobbin holder for supporting a bobbin and a frictionally-driven drive cylinder for contacting the bobbin includes continuously lifting the bobbin holder to different heights and lowering the bobbin holder causing the duration of the contact between the bobbin and the drive cylinder to continuously change, and a device for carrying out the method.

9 Claims, 1 Drawing Figure

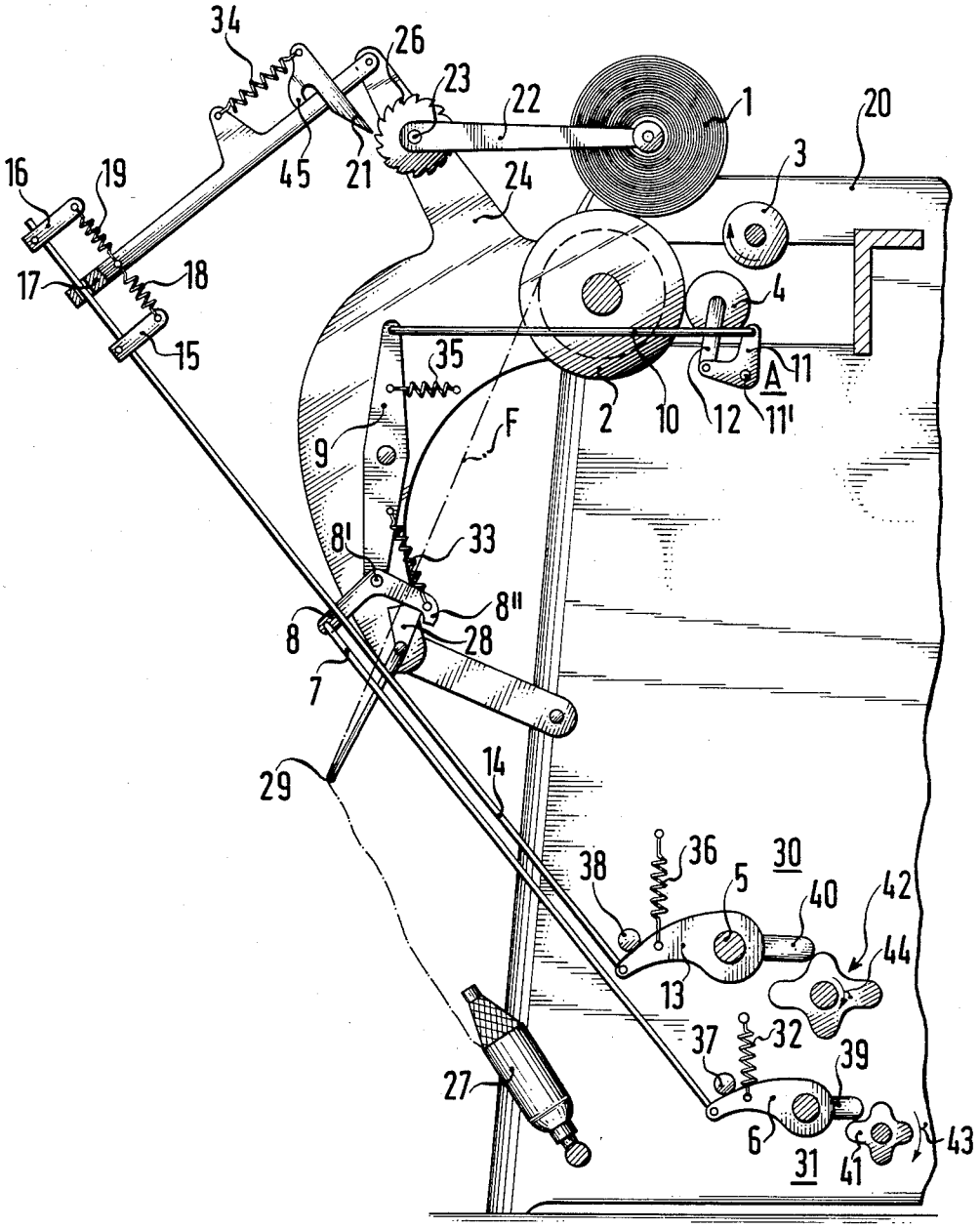
34
26
23
22
1
20
3
16
19
45
21
24
17
18
4
15
35
A
11
2
10
12
11'
9
F
33
8'
8''
8
28
7
29
14
36
30
38
5
40
42
44
13
37
32
39
27
6
31
41
43

METHOD AND DEVICE FOR AVOIDING IRREGULAR OR RIBBON WINDINGS DURING THE WINDING OF CHEESES OR CROSS-WOUND BOBBINS

The invention relates to a method and a device for avoiding irregular or ribbon windings during the winding of cross-wound bobbins or cheeses which are mounted on a movable bobbin holder and are in contact with a frictionally-driven drive cylinder.

Methods and devices of this type serve the purpose of avoiding irregular or ribbon windings which are created from time to time during the winding operation, especially within certain regions of the diameter. These irregular or ribbon windings are formed of either closely adjacent or overlapping windings.

For example, the formation of irregular or ribbon windings is avoided by providing a time-limited drive connection for the drive cylinder by means of a friction roller with a drive shaft, which swings in periodically. After interrupting the drive, as the friction roller swings in again, there is slippage between the cheese and the drive cylinder, whereby irregular or ribbon windings being formed are disturbed and loosened.

However, the above-mentioned measures do not completely avoid the formation of such irregular or ribbon windings. For relatively long time periods, the cheese rotates with the same circumferential velocity as the drive cylinder and if the thread guide moves in synchronism with the rotation of the cheese, some small irregularly wound zones are still formed. In spite of the fact that these irregularities are kept small, they are still disturbing when the yarn is withdrawn from the cross-wound bobbins.

It is accordingly an object of the invention to provide a method and device for avoiding irregular or ribbon windings during the winding of cheeses or cross-wound bobbins, which overcomes the hereinafore-mentioned disadvantages of the heretofore-known methods and devices of this general type, and to prevent the occasional occurrance of irregular winding formations without great expenditures.

With the foregoing and other objects in view there is provided, in accordance with the invention, a method for avoiding irregular or ribbon windings while winding cross-wound bobbins or cheeses with scrambled or wild windings, including a movable bobbin holder for supporting a bobbin and a frictionally-driven cylinder for contacting the bobbin, which comprises continuously lifting the bobbin holder to different heights or levels and lowering or dropping the bobbin holder causing the pressure and/or duration of the contact between the bobbin and the drive cylinder to continuously change.

If the bobbin holder is repeatedly and continuously lifted to different heights or levels, so that the contact between the cheese and the drive cylinder continuously changes with respect to duration and/or contact pressure, a synchronous operation between the rotation of the cheese and the rhythm of the thread guide can not exist for sufficiently long periods of time to form disturbing irregular winding patterns.

However, since it is desirable to maintain an approximately uniform peripheral speed of the cheese on average, it is advantageous to always bring the bobbin holder back to the unlifted state, and to thereby ensure that the cheese is moved along effectively by the drive cylinder.

In accordance with another feature of the invention there is provided a method which includes limiting the duration of the lowered or unlifted condition of the bobbin holder to periods of at least 100 milliseconds.

In accordance with a further feature of the invention there is provided a method including a drive for the drive cylinder, which includes continuously engaging and disengaging the drive for the drive cylinder.

In order to implement the method there is provided a device for avoiding irregular ribbon windings while winding cross-wound bobbins with scrambled windings, which includes a frictionally-driven drive cylinder for contacting a bobbin, a movable bobbin holder for supporting the bobbin, and a controllable lifting device connected to the bobbin holder for lifting the bobbin holder to continuously changing heights. The bobbin holder is always only lifted a very small distance. It has been proven to be of advantage, if the bobbin holder is always lifted in such a way that the cheese is lifted about 0.5 millimeters during the first stroke, and about 1 millimeter during the second stroke. In general, it is sufficient to lift the cheese continuously and alternatingly about these two stroke levels.

In accordance with a concomitant feature of the invention, there is provided a device which includes a drive for the drive cylinder, and means for controllably engaging and disengaging the drive. This is done in order to achieve an additional effect for avoiding irregular patterns. The engagement and disengagement of the drive of the drive drum may occur periodically, or even better, it may be performed periodically. Other features which are considered as characteristic for the invention are set forth in the appended claims. Although the invention is illustrated and described herein as embodied in a method and device for avoiding irregular or ribbon windings during the winding of cheeses or cross-wound bobbins, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantges thereof will be best understood from the following description of specific embodiments when read in connection with the single FIGURE of the drawing which is a fragmentary, diagrammatic, partly cross-sectional side-elevational view of a cross winding machine.

Referring now to the FIGURE of the drawing in detail, it is seen that the cross winding machine has a cheese or cross-wound bobbin 1 with a thread F coming from a creel bobbin or run-off spool 27. The cheese 1 lies on a drive cylinder 2, and is set in rotation by the drive cylinder through friction. The cross-wound bobbin 1 which rests on the drive cylinder 2 and is driven thereby is a relatively soft and elastic object. Furthermore, the surface of the bobbin 1 is uneven especially since it has scrambled windings, and it is fibrous because of the fibers protruding from the bobbin.

A drive roller 3 which is continuously driven with constant velocity, is disposed near this drive cylinder 2. A drive for the drive cylinder 2 is designated as a whole with the reference symbol A, and is formed of a friction roller 4 which is supported on a strap 12. The strap 12 articulates with an angle lever 11. The drive A can be moved from the disengaged position shown into the engaged position by swinging the angle lever 11 around a pivot point 11', whereby the friction roller 4 makes contact with the drive roller 3 and the drive cylinder 2. The drive A has an engaging/disengaging device 31. This engaging/disengaging device 31 is formed of a pivotally supported lever 6 which bears against a stop 37 by the action of a spring 32. The lever 6 has a trigger cam 39 which is alternatingly activated by a star wheel 41, if the star wheel 41 rotates in the direction of an arrow 43. As soon as one of the four switching arms of the star wheel 41 acts on the trigger cam 39, the lever 6 swings downward against the force of the spring 32, and transmits its motion through a rod 7 to a rocker arm 8. With the thread running, the rocker arm 8 bears against the upper part 28 of a feeler 29, and moves a rocking lever 9, a rod 10 and the angle lever 11, which was mentioned above. Finally, the angle lever 11 transfers the motion to the friction roller 4, and thereby brings the drive A into the engaged position. As soon as the rod 7 moves downward, the rocker arm 8 pivots around a pivot point 8', the nose 8'' of the arm 8 looses contact with the part 28 due to the action of a spring 33, the rocking lever 9 swings clockwise under the action of a spring 35, and the rod 10 moves to the right, which moves the angle lever 11 clockwise.

Subsequently, if the rod 7 moves upward again, the spring 33 causes the rocker arm 8 to engage again behind the part 28, and the drive A moves into the disengaged position, shown in the FIGURE.

The bobbin holder 22 which carries the cheese 1, is pivotally supported on an arm or bracket 24 of a machine frame 20. A ratchet wheel 26 with teeth is fastened to a pivot shaft 23 of the bobbin holder 22, so that a locking latch or pawl 21 can engage in the ratchet wheel 26. The pawl 21 is supported on a pivoted lever 17, in such a way that a stop 45 thereof lies against the lever 17 due to the action of a tension spring 34, but can give way against the force of the spring 34, if the teeth of the ratchet wheel 26 swing back.

A tie rod 14 is connected to the lever 17 by tension springs 18, 19 and levers 15, 16. The lower end of the rod 14 articulates with a lever 13 which is part of a lifting device 30. The lever 13 is pivotable around a shaft 5 and lies against an adjustable stop 38, under the action of a spring 36. The lever 13 also is provided with an trigger cam 40 which lies within the range of motion of a star wheel 42. The star wheel 42 is provided with pairs of switching arms of uneven length. The circumferential lengths of the arms vary. The arms of the star wheel are not pins all having the same thickness. Instead, they have smooth run-up surfaces of different lengths and the trigger cam 40 also has a rounded end surface running-up on the surface for different lengths of time. All of these parts together form the controllable lifting device 30, which moves the bobbin holder 22 into continuously changing height levels or inclinations.

If the star wheel 42 continues to rotate in the direction of an arrow 44, its longer switching arm lifts the trigger cam 40, and thereby moves the tie rod 14 obliquely downward. This motion is transferred to the lever 17, so that the pawl 21 engages behind one of the teeth of the ratchet wheel 26, and lifts the bobbin holder 22 the required amount through the motion of the lever 17. As the star wheel 42 continues to rotate, the above-mentioned parts are moved back, until the lever 13 again contacts the stop 38.

If the bobbin 1 is lifted to a small degree it will not lose contact with the drive cylinder 2 although after further lifting, contact will be lost. Nevertheless, when the bobbin is lifted to a small degree, contact between the drive cylinder and bobbin and the pressure therebetween will unquestionably vary, as is true of any elastic object. Accordingly, lifting the bobbin to different heights will change the pressure of the contact between the bobbin and the drive cylinder, as long as the bobbin is not lifted too far. As mentioned above, the cheese may be lifted as little as 0.5 mm during a stroke. Lifting a soft and elastic bobbin having uneven windings and fibers sticking out it only 0.5 mm, will not cause the bobbin to lose contact completely with the drive cylinder, but rather only the amount of pressure applied by the bobbin to the drive cylinder will be decreased. Raising and lowering bobbin to different heights will therefore vary the pressure therebetween.

Depending on the rotational velocity of the star wheel 42, the period of time during which the lever 13 contacts the stop 38 is very short, and is in the order of milliseconds. The distance between the pawl 21 and the ratchet wheel 26 is adjusted in such a way, and the angular velocity of the star wheel 42 is controlled in such a way, that the phase of the unlifted state of the bobbin holder 22 is limited to a maximum of 100 milliseconds.

By adjusting the levers 15, 16, which have a shim, the pawl 21 can be precisely adjusted. In general, the invention is not limited to the illustrated and described embodiment which is used as an example.

We claim:

1. Method for avoiding irregular or ribbon windings while winding cross-wound bobbins with scrambled windings, including a movable bobbin holder for supporting a bobbin and a frictionally-driven drive cylinder for contacting the bobbin, which comprises continuously lifting the bobbin holder to different heights and lowering the bobbin holder causing the duration of the contact between the bobbin and the drive cylinder to continuously change.

2. Method for avoiding irregular or ribbon windings while winding cross-wound bobbins with scrambled windings, including a movable bobbin holder for supporting a bobbin and a frictionally-driven drive cylinder for contacting the bobbin, which comprises continuously lifting the bobbin holder to different heights and lowering the bobbin holder causing the pressure of the contact between the bobbin and the drive cylinder to continuously change.

3. Method for avoiding irregular or ribbon windings while winding cross-wound bobbins with scrambled windings, including a movable bobbin holder for supporting a bobbin and a frictionally-driven drive cylinder for contacting the bobbin, which comprises continuously lifting the bobbin holder to different heights and lowering the bobbin holder causing the pressure and duration of the contact between the bobbin and the drive cylinder to continuously change.

4. Method according to claim 1, which comprises limiting the duration of the lowered condition of the bobbin holder to periods of at least 100 milliseconds.

5. Method according to claim 2, which comprises limiting the duration of the lowered condition of the bobbin holder to periods of at least 100 milliseconds.

6. Method according to claim 1, including a drive for the drive cylinder, which comprises continuously engaging and disengaging the drive for the drive cylinder.

7. Method according to claim 2, including a drive for the drive cylinder, which comprises continuously engaging and disengaging the drive for the drive cylinder.

8. Device for avoiding irregular ribbon windings while winding cross-wound bobbins with scrambled windings, comprising a frictionally-driven drive cylinder for contacting a bobbin, a movable bobbin holder for supporting the bobbin, and a controllable lifting device connected to said bobbin holder for lifting said bobbin holder to continuously changing heights and lowering said bobbin holder.

9. Device according to claim 8, including a drive for said drive cylinder, and means for controllably engaging and disengaging said drive.

* * * * *